United States Patent [19]

Todd

[11] Patent Number: 4,987,848

[45] Date of Patent: Jan. 29, 1991

[54] RADAR REFLECTING SAFETY FLAG

[76] Inventor: David P. Todd, P.O. Box 662, Dania, Fla. 33004

[21] Appl. No.: 462,878

[22] Filed: Feb. 26, 1990

Related U.S. Application Data

[63] Continuation of Ser. No. 64,076, Jun. 18, 1987, abandoned, which is a continuation-in-part of Ser. No. 846,099, Mar. 31, 1986, abandoned.

[51] Int. Cl.[5] ..... G09F 17/00

[52] U.S. Cl. ..... 116/173; 116/209

[58] Field of Search ..... 116/173-175, 116/209, 210; 139/425 R; 342/5-10; 343/897, 912, 915; 428/242, 256-258; 441/20, 36, 88, 89

[56] References Cited

U.S. PATENT DOCUMENTS

| | | | |
|---|---|---|---|
| 2,412,562 | 12/1946 | Crawshaw | 139/425 R |
| 2,534,710 | 12/1950 | Golian | 441/20 |
| 2,619,303 | 11/1952 | Martin | 244/33 |
| 2,731,046 | 1/1956 | Bachner | 139/420 R |
| 2,807,287 | 9/1957 | Frey | 139/419 |
| 2,910,096 | 10/1959 | Frey | 139/419 |
| 3,019,457 | 2/1962 | Lowery | 441/36 |
| 3,047,860 | 7/1962 | Swallow et al. | 343/915 |
| 3,587,098 | 6/1971 | Gosnell | 343/915 |
| 3,986,530 | 10/1976 | Maekawa | 139/425 |
| 4,099,282 | 7/1978 | Townsend | 441/16 |
| 4,167,007 | 9/1979 | McGeoch et al. | 342/44 |
| 4,320,403 | 3/1982 | Ebneth et al. | 343/756 |
| 4,431,316 | 2/1984 | Massey | 383/113 |
| 4,471,015 | 9/1984 | Ebneth | 428/195 |
| 4,475,476 | 10/1984 | Howard | 116/210 |
| 4,768,739 | 9/1988 | Schnee | 244/146 |

OTHER PUBLICATIONS

Raftery et al., TID-4500 (15th) Instruments, "SCTM-142 A-57(52), A Survey of Fast-rising Balloons and Rawin Reflectors", Oct. 1960, p. 9.

*Primary Examiner*—William A. Cuchlinski, Jr.
*Assistant Examiner*—W. Morris Worth
*Attorney, Agent, or Firm*—Hale and Dorr

[57] ABSTRACT

A dual purpose visual identification and safety flag comprising at least one sheet portion carrying a non-emergency visible identification display and substantially coextensive with the sheet portion, a flexible radar reflecting portion of silver anodized rip-stop nylon.

7 Claims, 2 Drawing Sheets

RADAR REFLECTING SAFETY FLAG

BACKGROUND OF THE INVENTION

This invention relates generally to devices for reflecting radar waves, and in particular to flags for reflecting radar waves. This is a continuation of copending application Ser. No. 07/064,076 filed on June 18, 1987 now abandoned, which is a Continuation-in-Part of U.S.S.N. No. 846,099, filed Mar. 31, 1986, entitled "Radar Flag" also now abandoned.

Small boats are frequently made of fiberglass. Fiberglass, being lightweight and resistant to the elements has many advantages. However, fiberglass does not reflect radar waves, and therefore, boats are not detectable by radar waves reflecting from the hulls. There is a serious need for a radar reflection device on small boats, to prevent avoidable collisions and losses of life. People who hike, hunt, camp or climb in remote areas are also lost because they carry no detectable device for location by radar.

A radar reflecting device for use on boats is known, however the device is made of metal plates. Consequently, the plates render the device cumbersome and further may damage the boat intended to be saved. It is also known to equip small boats with deployable devices including radar reflecting pennants. See for instance U.S. Pat. No. 4,099,282 to Townsend. It is also known to equip life jackets with extendable tubes equipped with radar reflecting pennants. See for instance U.S. Pat. No. 4,475,476, to Howard.

Known devices suffer from many deficiencies. First, no known device combines a flag carrying a regularly displayed identification with a radar reflecting flag. Thus, it is necessary to specifically deploy the radar reflecting flag. In an emergency, it may be impossible to deploy the radar reflecting device, due to incapacity of the crew, inclement weather, or misplacement of the radar reflecting device. Further, the necessity to deploy the device adds an extra task to be performed by a crew that may be already stressed to its limits.

Further, the known radar reflecting devices use different methods to incorporate the radar reflecting components into the pennant, all of which have drawbacks. Weaving individual metal or anodized threads into a fabric made up of non-metallic threads is prohibitively expensive. Mylar, which has been proposed as the radar reflecting material, is relatively weak and breaks down under the buffetting stress of the wind and corrosive sea environment. It has also been proposed to use anodized or metal coated nylon threads. The wind constantly stresses and flexes the pennant, to the extent that any anodization or coating eventually cracks and flakes off, thereby destroying the radar reflecting capacity of the fabric.

Objects of the invention are therefore to provide a radar reflecting device that is regularly displayed, sufficiently durable, portable, low cost, easy to install, dual function and will save lives.

SUMMARY OF THE INVENTION

The invention is a portable, radar reflecting flag that may be flown by boats, carried furled in lifeboats and may be displayed by hikers, hunters, campers, climbers, etc. All vessels display a flag of one kind or another. The invention therefore also provides a dual function safety device. The radar reflecting flag is a suitably sized flag made of a durable thread, such as nylon and metallic threads of a sufficient concentration to render the flag detectable by radar waves. The metal threads may be made by a process where metallic particles actually impregnate the body of nylon or other synthetic threads, rather than simply coating the outside surface of the threads. Due to this impregnation, the metallic threads maintain their integrity under the severe conditions of nautical use, and do not lose their radar reflecting capacity. In addition to being portable and serving a dual function, the manufacturing costs of the flag are modest. The flag may be easily installed and used.

DETAILED DESCRIPTION OF THE PREFERRED EMBODIMENTS OF THE INVENTION

Figure 4:
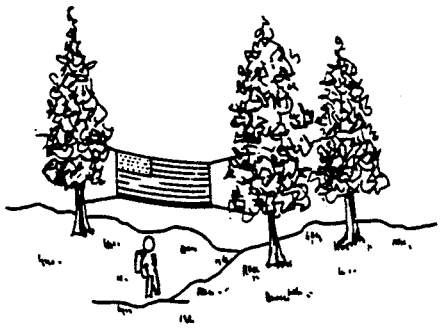
FIG. 4 shows schematically how a hiker might use the flag.
Figure 5:
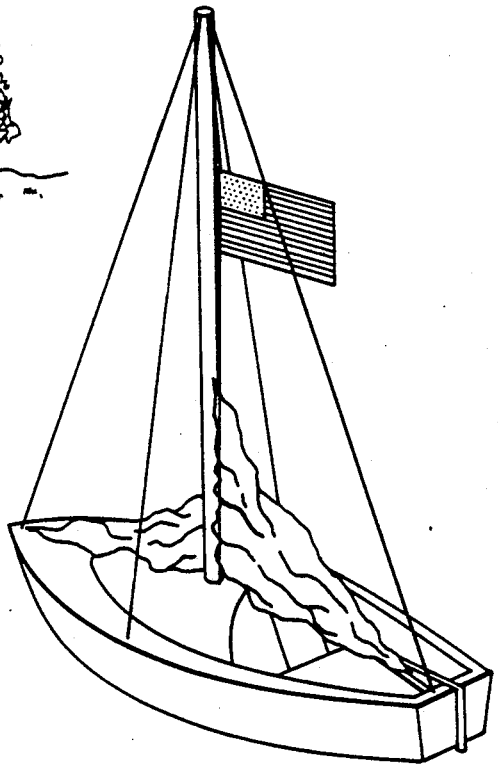
FIG. 5 shows schematically how the flag might be used on a small boat.

The invention will be most readily understood with reference to the figures and the following discussion. Because small and large boats customarily fly flags or pennants of some sort, to combine the flag or pennant with a device for reflecting radar waves will serve a dual function. FIG. 5 shows one way in which the flag of the invention may be used by boaters. The requirements for the location of the flag relative to the water's surface are discussed below. The manner in which the flag or pennant may be used by a hiker or other adventurer is shown in FIG. 4.

Figure 3:
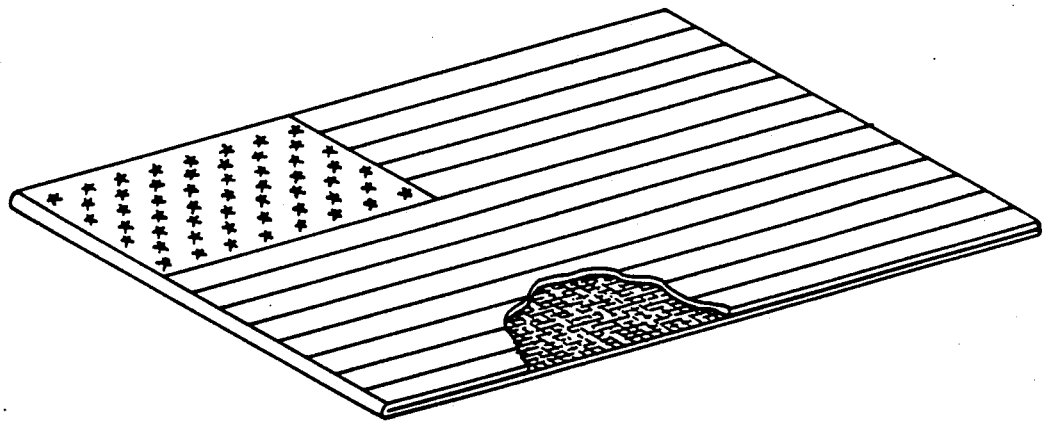
FIG. 3 shows a perspective view of a laminated embodiment of the flag, with a portion of an outer lamination cut away to reveal the portions shown in FIGS. 1 and 2 indicated at X.

A preferred embodiment of the flag 10 is shown schematically in FIG. 3. FIG. 3 shows generally an American flag. It will be understood, of course that the flag may display any regularly displayed identification, such as the name of the boat, the name of the yacht club, a slogan, etc. The important feature is that the flag be of the sort that will fly on the boat at all times, thereby obviating the need to specifically deploy the flag during an emergency.

Figure 1:
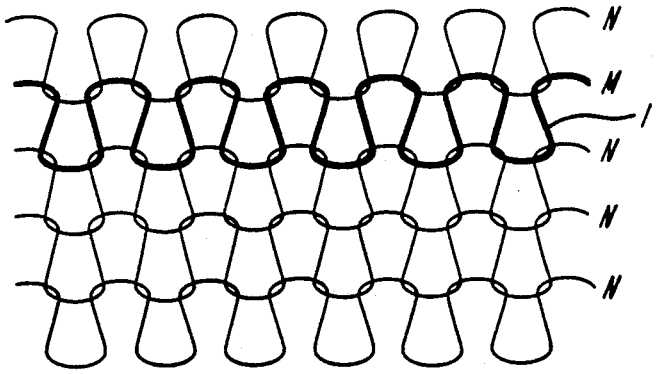
FIG. 1 shows the weave of a metal thread throughout one embodiment of a flag of the invention in an "S" pattern, to allow for stretch of the fabric in severe use situations.
Figure 2:
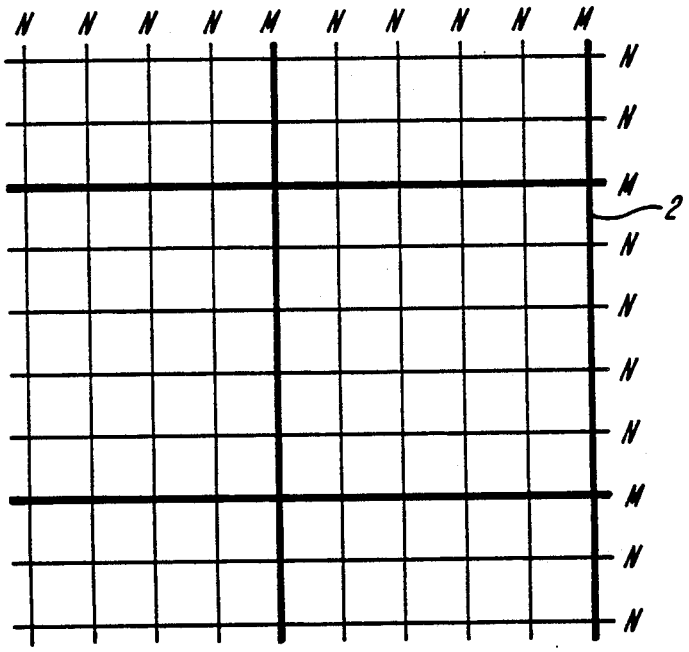
FIG. 2 shows a standard weave of the metal and non-metallic threads throughout another embodiment of the flag.

The flag consists of two outer lamination sheets 12 and 14 made of a durable material, such as nylon. Encased between the outer lamination sheets is a layer of radar reflecting material. The radar reflecting material may be either in sheet form, such as a Mylar TM material or it may be woven. The weave may be a standard warp and weft weave as shown in FIG. 2, or it may be an "S" shaped chain weave as shown in FIG. 1. The embodiment featuring the "S" shaped weave of FIG. 1 is particularly useful in conditions where the flag will be subjected to stretching stresses.

Whether woven as in FIG. 1 or FIG. 2, the flag consists of an appropriately sized piece of material woven from a combination of a durable thread, such as nylon, and a metallic thread. In FIG. 1, the metallic threads are designated "M" and the durable threads are designated "N". Similar designations identify the respective threads shown in FIG. 2.

The metallic threads may be treated in a variety of ways, including being coated, electroplated or polymered. The important aspect of the metallizing of the threads is that the metallizing must be extremely durable and permanent. Flags carried by small boats experience extremes of stress due to the actions of wind, rain, sun, and chemical corrosion. The metal used for the metallic threads should be as non-corrosive as possible, and can be any metal that will reflect radar waves, such as aluminum, copper, nickel, steel and tin.

It has been found that the most suitable process for metallizing the thread is a process used by the Swift Metal Textile Corporation of P. 0. Box 150, Hartford, Conn. 06141. Thread embodying his process is available from Swift in a silver treated light rip-stop nylon sold under style #C7020-4. The process is proprietary to Swift Metal Textile Corporation. It is believed that as a result of the process, the metal particles impregnate the nylon threads, rather than merely coating or adhering to the outside surface. It has been found that the metallized rip-stop nylon available from Swift provides superior results.

The ratio of the metal to durable threads must be such that the flag will reflect radar waves of a range normally used in the places where the flag will be used, such as at sea. It has been found that if the ratio of nylon threads to metal threads is between 8 to 1 and 4 to 1, suitable results are obtained. As can be seen from FIG. 2, where a durable thread to metal thread ratio of 4 to 1 is illustrated, the group of 4 durable threads N may be alternated with the single metal thread M. Similarly, in the "S" shaped embodiment, the single metal thread M alternates with the four (three only are shown) durable threads N.

With respect to the size of the flag, it has been found that a flag of a minimum of 12" by 18" will provide suitable results and 20" by 30" is recommended.

When used with small boats, the radar flag should be mounted in place of the boat's regularly displayed flag. It should be flown at all times when the boat is occupied. In any case, the flag should be mounted at least two and one half feet above the water surface. With small, low riding boats, such as life boats, the flag of the invention should be mounted to the highest possible point.

When used by hikers, climbers, etc., the flag should be spread on or attached to a high point, such as a bush or tree.

When used as a flag, the flag of the invention should include means for mounting the flag to a flag pole or mast, as shown in FIG. 5 The edges and borders of the flag should also be strongly fortified to prevent fraying of the fabric.

Intricate radar reflection may also be achieved by taking advantage of a property that arises if the metal of the warp of the weave differs from the metal of the weft. If the metal of the warp has a valence of plus 3, such as copper, and the metal of the weft has a valence of plus one, such as nickel, and if the metal wires contact at their intersections, a magnetic or electric field will be created.

The radar reflecting material may also be used to associate an alpha or numeric identification with a target. This designation is useful for military applications.

The foregoing discussion should be considered as illustrative and not limiting in any sense. The flag may be any sort regularly displayed by ships or hikers. The process for metallizing the threads of the flag may be any process that durably metallizes the fabric of the flag. Other modifications will occur to those skilled in the art.

Having thus described the invention, what is claimed is:

1. A dual purpose visual identification and safety flag comprising at least one sheet portion carrying anon-emergency visible identification display and substantially coextensive with the sheet portion a flexible radar reflecting portion of silver anodized rip-stop nylon and means for attaching the flag to a support.

2. The flag of claim 1 wherein the radar reflecting portion exceed 12 inches by 18 inches in size.

3. The flag of claim 1 where the at least one sheet portion comprise at least two sheet layers of a durable material which sandwich the radar reflecting portion between the sheet layers.

4. The flag of claim 3 further wherein the sheet layers and radar reflecting portion are laminated together.

5. A dual purpose identification and location flag comprising a flexible radar reflecting sheet portion of silver anodized rip-stop nylon carrying on a first side a non-emergency identification display sheet and carrying on a second side a non-emergency identification display sheet.

6. The flag of claim 5 wherein designations on the displays carried on said first and second sides of said flexible sheet are the same.

7. The flag of claim 5 wherein designation on the displays carried on said first and second sides of said flexible sheet are mirror images of each other.

* * * * *